United States Patent [19]

Meyer

[11] 4,340,837

[45] Jul. 20, 1982

[54] LOW VOLUME, LIGHTWEIGHT, HIGH VOLTAGE ELECTRON GUN

[75] Inventor: Thomas W. Meyer, Albuquerque, N. Mex.

[73] Assignee: The United States of America as represented by the Secretary of the Air Force, Washington, D.C.

[21] Appl. No.: 110,960

[22] Filed: Jan. 10, 1980

[51] Int. Cl.[3] ..... H01J 1/88; H01J 19/42

[52] U.S. Cl. ..... 313/259; 313/268; 313/450; 313/489

[58] Field of Search ..... 313/258, 259, 446, 447, 313/452, 242, 268, 289, 361, 450, 489, 355, 479; 250/396

[56] References Cited

U.S. PATENT DOCUMENTS

| | | | |
|---|---|---|---|
| 2,005,021 | 6/1935 | Brasch et al. | 313/368 |
| 2,063,314 | 12/1936 | Johnson et al. | 313/258 |
| 3,142,776 | 7/1964 | Wells et al. | 313/289 |
| 3,516,906 | 6/1970 | Bennett | 250/398 X |
| 3,809,939 | 5/1974 | Miram et al. | 313/289 |
| 3,914,637 | 10/1975 | Bennett | 250/396 |
| 3,963,955 | 6/1976 | Miran et al. | 313/446 |
| 4,057,746 | 11/1977 | Dumonte | 313/346 |
| 4,079,285 | 3/1978 | Little | 313/355 |
| 4,115,722 | 9/1978 | Johnson | 313/342 |
| 4,121,128 | 10/1978 | Roberts | 313/361 |

*Primary Examiner*—Saxfield Chatmon, Jr.
*Attorney, Agent, or Firm*—Donald J. Singer; Jacob N. Erlich

[57] ABSTRACT

A low volume, lightweight, high voltage electron gun having an overall size and weight of approximately 50% the size and weight of a conventional electron gun of the same output. This is accomplished by interposing between the cathode and the walls of the housing of the electron gun a thin piece of dielectric material of preselected breakdown strength. The dielectric material is in direct contact with both the cathode and the housing of the electron gun, with the voltage stress between the walls of the housing and the cathode being such that it does not exceed the breakdown strength of the dielectric material.

4 Claims, 3 Drawing Figures

FIG. 1
PRIOR ART
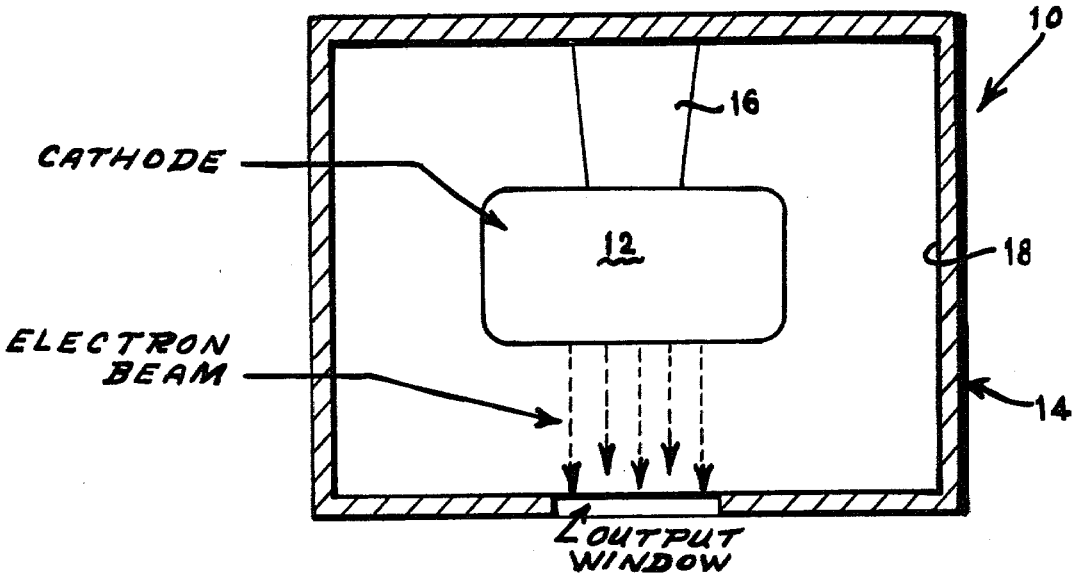
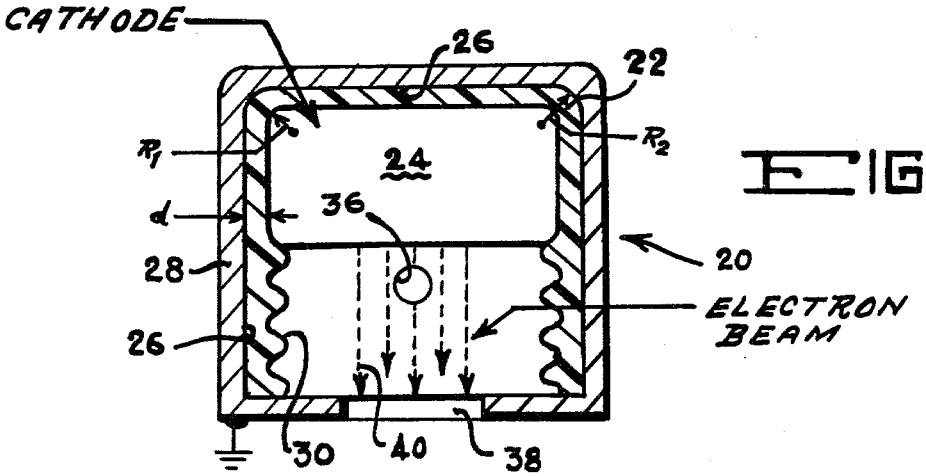
FIG. 2
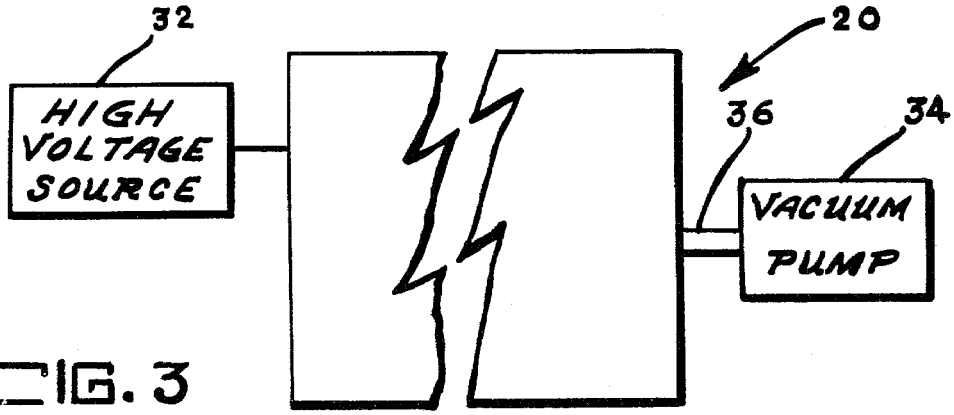
FIG. 3

LOW VOLUME, LIGHTWEIGHT, HIGH VOLTAGE ELECTRON GUN

STATEMENT OF GOVERNMENT INTEREST

The invention described herein may be manufactured and used by or for the Government for governmental purposes without the payment of any royalty thereon.

BACKGROUND OF THE INVENTION

This invention relates generally to electron guns, and, more particularly to an electron gun which is capable of producing a large output with reduced volume and being extremely lightweight so as to be easily incorporated within a laser system.

An electron gun is a device capable of producing a continuous of pulsed stream of electrons. Since the advent of the electric discharge or electro-dynamic laser, the electron gun has found increased utility in the laster field. Conventional high voltage electron guns or vacuum electron guns are generally large in volume and consequently quite heavy due to the large vacuum separation which is required between the cathode and vacuum enclosure in order to stand off the high voltage on the cathode.

Unfortunately size and weight are essential limitations in the construction of lasers. Since conventional high voltage vacuum electron guns are both large in size and extremely heavy in weight, substantial usage of, for example, electro-dynamic lasers has been subsequently limited. It is therefore essential to provide, not only in the laser field, but in any other field in which the emission of electrons is necessary, to produce an electron gun which is also of low volume and light weight construction.

SUMMARY OF THE INVENTION

The high voltage electron gun of this invention is capable of producing either a continuous or pulsed stream of electrons, and yet having a considerably smaller volume and less weight than the electron guns of the past and thereby overcoming the shortcomings of past electron guns as pointed out hereinabove.

The electron gun of the instant invention substantially eliminates the problems of the past by placing the vacuum enclosure or housing almost directly adjacent the cathode, being separated therefrom by only a thin dielectric spacer. Consequently, the reduction of volume of the electron gun of this invention also eliminates the requirement of a large vacuum pump such as required with electron guns of the past.

This electron gun is made up of a housing or enclosure in which the cathode is mounted. The cathode is mounted within the housing, separated from the walls of the housing by a thin piece of dielectric material sandwiched therebetween. Since a high vacuum is required in the enclosure of the electron gun, it is essential that the dielectric material have a low outgassing property. In addition, the thickness of the dielectric material must be sufficient to prevent breakdown between the cathode and the walls of the enclosure. The dielectric material not only separates the cathode from the adjacent housing wall, but also continues along the inside of the housing even in the area in which the cathode is not located terminating adjacent the bottom wall of the housing. The surface of the dielectric material located between the bottom of the cathode and the bottom wall of the housing is preferably corrugated to provide a longer path for breakdown. Located in the bottom wall of the housing and positioned opposite the cathode is an output window through which the electron beam can pass.

As a result of the configuration of the high voltage electron gun of this invention, it is possible to have a resultant volume savings of over 50% and a corresponding weight savings compared to the conventional high voltage electron guns of the past. Furthermore, since the volume of the electron gun of this invention is substantially half the volume of past electron guns a much smaller vacuum pump can be utilized therewith even further reducing the overall weight of the electron gun.

It is therefore an object of this invention to provide a high voltage electron gun of less volume and less weight than electron guns of the past.

It is another object of this invention to provide a high voltage electron gun which has substantially reduced the vacuum pump requirements.

It is still another object of this invention to provide a high voltage electron gun which is easily adaptable for use within a laser system.

It is still a further object of this invention to provide a high volume electron gun which is economical to produce and which utilizes conventional, currently available components.

For a better understanding of the present invention, together with other and further objects thereof, reference is made to the following description taken in conjunction with the accompanying drawing and its scope will be pointed out in the appended claims.

DETAILED DESCRIPTION OF THE DRAWING

FIG. 1 is a cross-sectional view of a conventional electron gun showing the basic components thereof.

FIG. 2 is a cross-sectional view of the high voltage electron gun of this invention shown in the same relative scale as the conventional electron gun of FIG. 1; and FIG. 3 is a side view of the high voltage electron gun of this invention shown in segmented fashion.

DETAILED DESCRIPTION OF THE PREFERRED EMBODIMENT

Reference is now made to FIG. 1 of the drawing which shows a cross-sectional view of a conventional electron gun 10. As can be seen in FIG. 1 of the drawing, the volume of electron gun 10 is relatively large. In addition, for proper operation of the electron gun 10, cathode 12, which is mounted within a vacuum enclosure or housing 14 by a high voltage bushing 16, is separated by a great distance from all the walls 18 of the enclosure or housing 14 of electron gun 10. This relationship is maintained in order to stand off the high voltage on cathode 12.

The electron gun 20 of this invention, shown clearly in FIGS. 2 and 3 of the drawing, and drawn in substantially the same scale as electron gun 10 of FIG. 1 is approximately half the volume of the conventional electron gun 10. Such a reduced volume is accomplished by interposing a thin piece of dielectric material 22 between cathode 24 and the walls 26 of the grounded enclosure or housing 28 of electron gun 20. Cathode 24 is secured within housing 28, by any suitable securing means such a high strength, low outgassing adhesive such as epoxy. Enclosure or housing 28 is made of any good quality metal such as stainless steel, aluminum or titanium or a composite material such as boron epoxy. The dielectric material 22 may be made, for example, of any of a series of readily available polyethylenes.

In defining the relationship between the dielectric material 22 and the cathode 24, dielectric material 22 is not only interposed directly between cathode 24 and walls 26 of housing 28, but also adjacent that portion of wall 26 of housing 28 which is not directly adjacent cathode 24. In fact, in order to provide a longer path for breakdown, that portion 30 of dielectric material 22 not in contact with cathode 24 is corrugated. It is also critical that the voltage stress between walls 26 of housing 28 (the anode) and cathode 24 be such that it does not exceed the breakdown strength of the dielectric material 22 utilized.

The thickness of the dielectric material required can be determined from the following two formulas:

A. In the portion of electron gun 20 where cathode 24 and the adjacent wall 26 can be viewed as two parallel plates the electric field (E) is given by $$E=V/d \quad (1)$$

where V is the voltage on cathode 24 and d is the separation between cathode 24 and wall 26. If V is in volts and d is in meters the dimensions of E are volts/meter.

B. In the portion of electron gun 20 where cathode 24 and wall 26 can be considered as two concentric cylinders the electric field is given by $$E=V/[R_1 \ln(R_2/R_1)] \quad (2)$$

where $R_1$ is the radius of the inner cylinder, $R_2$ is the radius of the outer cylinder and ln is the natural logarithm.

As best shown in FIG. 3 of the drawing any suitable high voltage source 32 of, for example, 100,000–200,000 volts is operably connected to cathode 24 through a wall 26 of housing 28. Any suitable conventional vacuum pump 34 capable of producing a vacuum of approximately $10^{-5}$ to $10^{-7}$ torr within housing 28 is operably connected by a vacuum line 36 to the interior of housing 28. As with the conventional electron gun 10 shown in FIG. 1 of the drawing, any suitable output window 38 which may form an integral part of bottom wall 26 of housing 28 can be utilized to allow for the exiting of the resultant electron beam 40.

As an example of the desired reduction in overall volume of electron gun 20, assume 200,000 volts on cathode 24. Typical dielectric strengths for polystyrene range from 1.85 to $2.76\times10^5$ v/cm. This is the value at which breakdown could occur. If we choose an average value of $2.3\times10^5$ v/cm for the dielectric strength then the minimum thickness of the dielectric 22 using formula (1) is $$d=(V/E)=(200{,}000/230{,}000(v/v/cm)=0.87 \text{ cm.}$$

To be safe the dielectric should be at least three times as thick or about 2.61 cm. This dimension should be compared to the ten to fifteen cm dimension for vacuum electron guns of the past.

The design of the electron gun 20 of this invention results in a volume reduction of over 50% compared to the conventional electron gun 10 as shown in FIG. 1 of the drawing. This volume reduction allows for a corresponding reduction in weight in electron gun 20 not only due to the decrease in material utilized in the construction thereof, but also as a result of a smaller vacuum pump being required with the instant invention.

Although this invention has been described with reference to a particular embodiment, it will be understood to those skilled in the art that this invention is also capable of further and other embodiments within the spirit and scope of the appended claims.

I claim:

1. A low volume, lightweight, high voltage electron gun comprising a housing, said housing having sides made of electrically conductive material, one of said sides having means therein for allowing a stream of electrons to pass therethrough, a cathode, said cathode being mounted juxtaposed at least a portion of all of said sides of said housing except said side having said electron passing means therein, a high voltage source being operably connected to said cathode, said high voltage source producing at least one hundred thousand volts, a thin piece of solid dielectric material having a preselected breakdown strength being interposed between said cathode and said sides of said housing juxtaposed said cathode, said dielectric material being in direct contact with both said cathode and said sides of said housing juxtaposed said cathode as well as being in direct contact with all other portions of said sides of said housing except said side having said electron passing means therein, said preselected breakdown strength of said dielectric material being greater than the voltage stress between said cathode and said sides of said housing juxtaposed thereto and means operably connected to the interior of said housing for creating a vacuum therein.

2. A low volume, lightweight, high voltage electron gun as defind in claim 1 wherein said thin piece of dielectric material which contacts said sides of said housing but is not in contact with said cathode is corrugated on its surface facing said interior of said housing.

3. A low volume, lightweight, high voltage electron gun as defined in claim 1 wherein said housing is made up of six sides, said cathode being mounted juxtaposed five of said sides, and said electron passing means being situated in the sixth side of said housing.

4. A low volume, lightweight, high voltage electron gun for use in a laser comprising a housing, said housing having sides made of electrically conductive material, one of said sides having means therein for allowing a stream of electrons to pass therethrough, a cathode, said cathode having a substantially large area of emission and being mounted juxtaposed at least a portion of all of said sides of said housing except said side having said electron passing means therein, a high voltage source being operably connected to said cathode, said high voltage source producing at least one hundred thousand volts, a thin piece of solid dielectric material having a preselected breakdown strength being interposed between said cathode and said sides of said housing juxtaposed said cathode, said dielectric material being in direct contact with both said cathode and said sides of said housing juxtaposed said cathode as well as being in direct contact with all other portions of said sides of said housing except said side having said electron passing means therein, and wherein said thin piece of dielectric material which contacts said sides of said housing but is not in contact with said cathode is corrugated on its surface facing the interior of said housing, said preselected breakdown strength of said dielectric material being greater than the voltage stress between said cathode and said sides of said housing juxtaposed thereto and means operably connected to the interior of said housing for creating a vacuum therein.

* * * * *